US009255585B2

(12) United States Patent
Chen et al.

(10) Patent No.: US 9,255,585 B2
(45) Date of Patent: Feb. 9, 2016

(54) FAN STRUCTURE AND CASING STRUCTURE

(71) Applicants: Inventec (Pudong) Technology Corporation, Shanghai (CN); INVENTEC CORPORATION, Taipei (TW)

(72) Inventors: Hua-Feng Chen, Taipei (TW); Ting-Chiang Huang, Taipei (TW); Te-Chuan Wang, Taipei (TW)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 488 days.

(21) Appl. No.: 13/793,879

(22) Filed: Mar. 11, 2013

(65) Prior Publication Data

US 2014/0079544 A1 Mar. 20, 2014

(30) Foreign Application Priority Data

Sep. 14, 2012 (CN) ..... 2012 1 0341240

(51) Int. Cl.

| | |
|---|---|
| ***F04D 29/00*** | (2006.01) |
| ***F04D 29/40*** | (2006.01) |
| ***F04D 17/16*** | (2006.01) |
| ***F04D 25/06*** | (2006.01) |
| ***F04D 29/60*** | (2006.01) |

(52) U.S. Cl.
CPC ..... *F04D 29/40* (2013.01); *F04D 17/16* (2013.01); *F04D 25/0613* (2013.01); *F04D 29/601* (2013.01)

(58) Field of Classification Search
CPC ..... F04D 29/40; F04D 17/16; F04D 29/601; F04D 25/0613
USPC ..... 415/213.1
See application file for complete search history.

(56) References Cited

U.S. PATENT DOCUMENTS

2009/0084910 A1* 4/2009 White ..... H02G 3/0608 248/70
2012/0087790 A1* 4/2012 Zeng ..... F04D 25/0613 415/213.1

* cited by examiner

*Primary Examiner* — Zelalem Eshete
(74) *Attorney, Agent, or Firm* — Locke Lord LLP; Tim Tingkang Xia, Esq.

(57) ABSTRACT

A fan structure used for connecting with a plate body includes a main body, a fan blade, a sliding member and a locating member. The main body has an accommodating space and an adjustment slot. The fan blade is pivotally disposed on the main body and is located inside the accommodating space. The sliding member has a base and a joining portion. The base is accommodated in the adjustment slot. The sliding member is joined to the plate body through the joining portion. The locating member is used for joining the sliding member and the main body together, so as to fix the relative position of the sliding member and the main body.

5 Claims, 6 Drawing Sheets

FAN STRUCTURE AND CASING STRUCTURE

CROSS-REFERENCE TO RELATED APPLICATIONS

This non-provisional application claims priority under 35 U.S.C. §119(a) on Patent Application No(s). 201210341240.9 filed in China, P.R.C. on, 14 Sep. 2012, the entire contents of which are hereby incorporated by reference.

BACKGROUND OF THE INVENTION

1. Technical Field of the Invention

The disclosure relates to a fan structure and a casing structure, more particularly to a fan structure having adjustable screwing positions and a casing structure.

2. Description of the Related Art

Nowadays, in order for dissipating heat, an electronic device is usually equipped with a fan disposed inside it. When operating, the fan is capable of guiding cold air from outside into the electronic device. After cold air enters into the electronic device, heat exchange between cold air and heat generated by the electronic device occurs. Then, cold air is exhausted to the exterior environment through an opening of the electronic device.

The assembly of a fan and an electronic is usually conducted via screwing. Generally speaking, a fan has at least one through hole, and is fixed to a screwing hole of the casing of the electronic device through a screw filling a through hole. Thereby, the assembly of a fan and an electronic device is finished.

Nonetheless, the casings thereof are different from each other due to different layouts inside the electronic devices. Hence, when the position of a through hole of the fan is different from the lock hole of the casing to be locked in, a new fan involves a new mould having the corresponding lock holes is needed to finish assembly. Thereby, a variety of fans having different lock holes are required for being assembled inside different electronic devices by assembly factories. However, the manufacturing time and cost are affected by the number of types of fans produced by the manufacturing factories.

SUMMARY OF THE INVENTION

In an embodiment, the disclosure provides a fan structure configured for connecting with a plate body comprising a main body, a fan blade, a sliding member and a locating member. The main body has an accommodating space and an adjustment slot. The fan blade is pivotally disposed on the main body and is located inside the accommodating space. The sliding member has a base and a joining portion. The base is accommodated in the adjustment slot. The sliding member is joined to the plate body through the joining portion. The locating member is configured for joining the sliding member and the main body together, so as to fix the position of the sliding member relative to that of the main body.

The disclosure further provides a casing structure configured for connecting with a plate body. The casing structure comprises a main body, a sliding member and a locating member. The main body has an adjustment slot. The sliding member has a base and a joining portion. The base is disposed on the adjustment slot. The sliding member is joined to the plate body via the joining portion. The locating member configured for joining the sliding member and the main body together, so as to fix the position of the sliding member relative to that of the main body.

BRIEF DESCRIPTION OF THE DRAWINGS

The present disclosure will become more fully understood from the detailed description given herein below for illustration only, and thus does not limit the disclosure, wherein.

DETAILED DESCRIPTION

Figure 1:
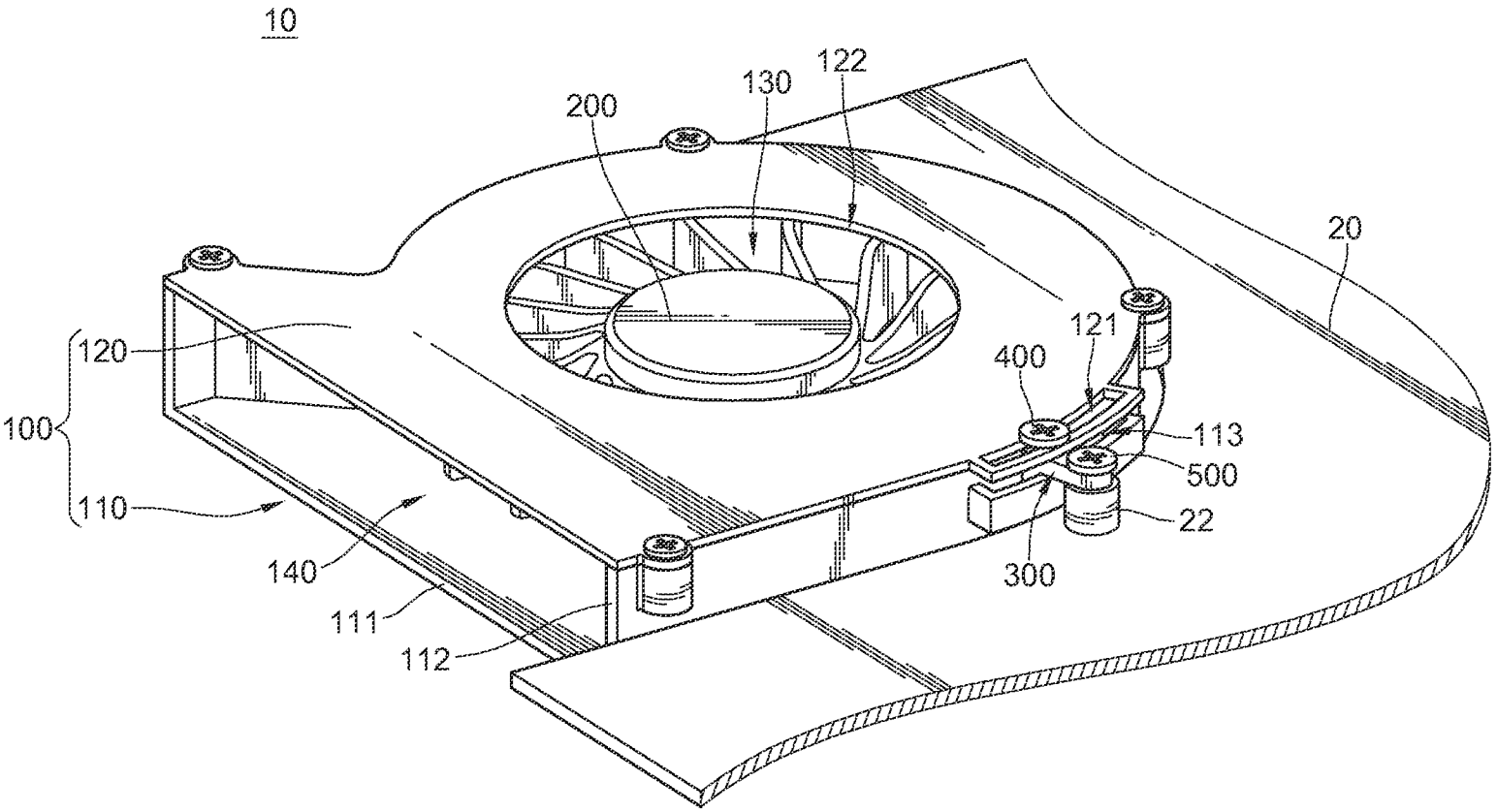
FIG. 1 is a perspective view of a fan structure according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
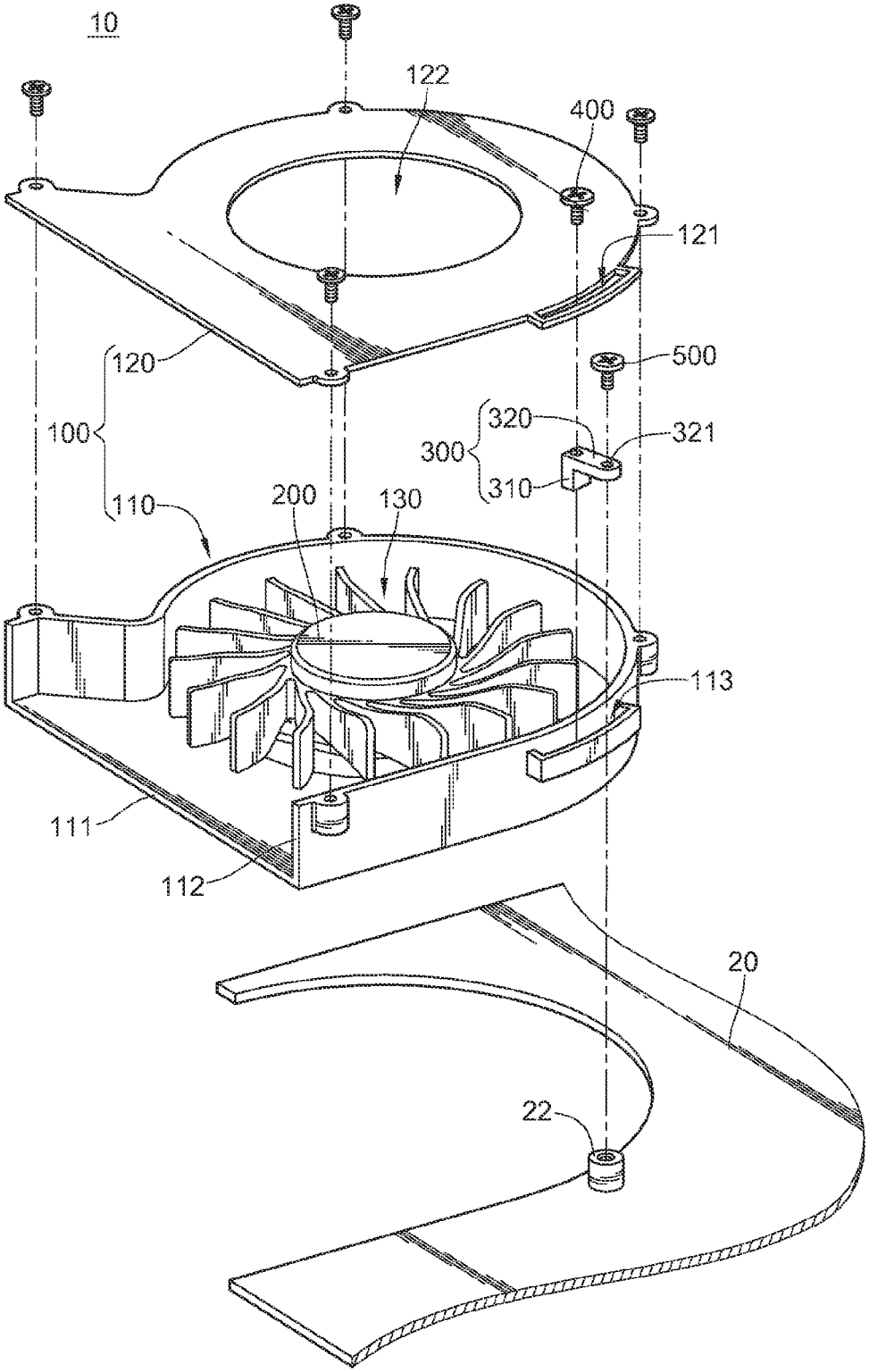
FIG. 2 is an exploded view of FIG. 1.

Please refer to FIG. 1 and FIG. 2. FIG. 1 is a perspective view of a fan structure according to an embodiment of the disclosure. FIG. 2 is an exploded view of FIG. 1.

In this embodiment, the fan structure 10 is configured for being joined to a plate body 20. The plate body 20 comprises a locking portion 22 for fan structure 10 to lock. In this embodiment, the plate body 20 is a circuit board of the notebook, but it is not limited thereto. Moreover, in this embodiment, the fan structure is used for illustration. In other embodiments, casing structures of other electronic devices are also applicable so the disclosure is not limit to the fan structure 10.

In this embodiment, the fan structure 10 comprises a main body 100, a fan blade 200, a sliding member 300 and a locating member 400. The main body 100 has an accommodating space 130 and an adjustment slot 113. Specifically, the main body comprises a carrier 100 and a cover 120. The carrier 110 has a bottom plate 112 and a lateral plate 112 erecting and adjacent to the bottom plate 111. The cover 120 is fixed to the lateral plate 112, and the connection between them may be done by screwing up them or by hot-melt adhesive. In this embodiment, the assembly is conducted by screw locking. Furthermore, the carrier 110 and the cover 120 form the accommodating space 130 mentioned above. The adjustment slot 113 is located at the exterior wall located at the lateral plate 112, and therefore forms a predetermined track. The exterior wall is a side, near the plate body 20, of the lateral plate 112. Additionally, the cover 120 has a locating slot 121. The position of the locating slot 121 corresponds to that of the adjustment slot 113.

The fan blade 200 is pivotally disposed on the bottom plate 111 and is located inside the accommodating space 130. Driven by an external force, the fan blade 200 is configured for generating an air current from outside of the fan structure 10 into the accommodating space 130. Then, the air current is guided to leave the accommodating space 130. Specifically, the cover 120 has an air intake vent 122. A side of the lateral plate 122 has an air outlet 140. The fan blade is configured for guiding an air current from the air intake vent 122 into the accommodating space 130, then guiding the air current to leave the air outlet 140.

The sliding member 300 has a base 310 and a joining portion 320 connected to each other. An included angle is formed by the base 310 and the joining portion 320, so as to make the sliding member be in the "L" shape. Moreover, the base 310 is movably disposed inside the adjustment slot 113. The joining portion 320 extends from base 310 towards a direction away from the lateral plate 112. The joining portion has a locking hole 321 and the locking hole 321 is joined to the locking portion 22 via a locking member 500 disposed through the locking hole 321. Thereby, the fan structure is joined to the plate body 22 via the sliding member 300. In other words, the sliding member is joined to the plate body 22 via the joining portion 320. The locking member is a screw but it is not limited thereto.

The locating member 400 is detachably disposed on the sliding member 300 and the main body 100, so as to fix the relative positions of joining portion 320 and the main body 100. Specifically, the locating member 400 is, for example, a screw. The locating member 400 is disposed through the locating slot 121 of the main body 100 and the base 310 of the sliding member 300 and is tightened and locked to them. Thereby, the relative positions between the joining portion 320 and the main body 100 is fixed. The locating member 400 can be loosened when the joining portion 320 is desired to be moved relative to the main body 100. At this point, the joining portion 300 is configured for moving relative to the main body along a track formed by the adjustment slot 113 again.

Figure 3A:
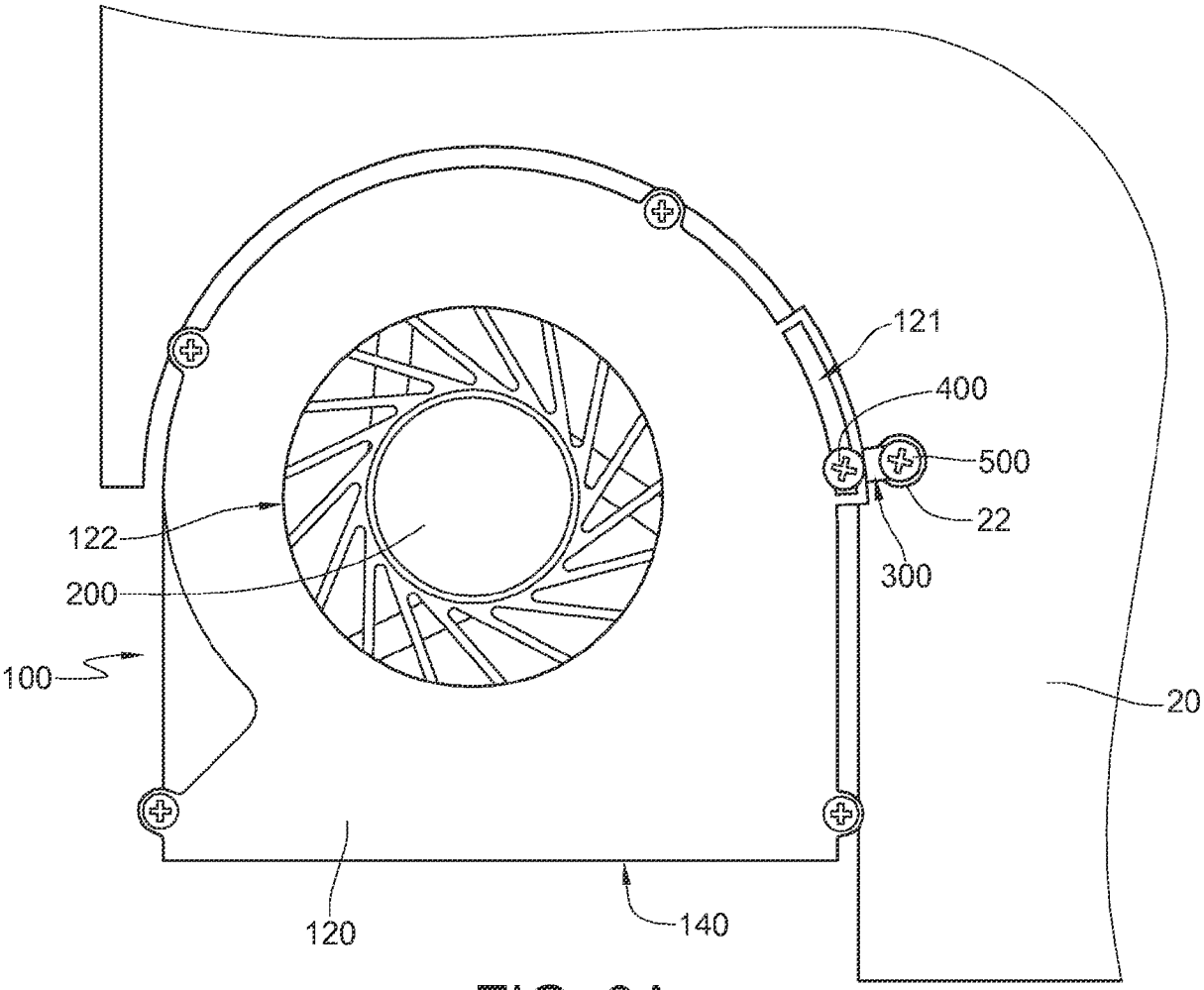
FIG. 3A and FIG. 3B are plan views of different locking holes in FIG. 1.
Figure 3B:
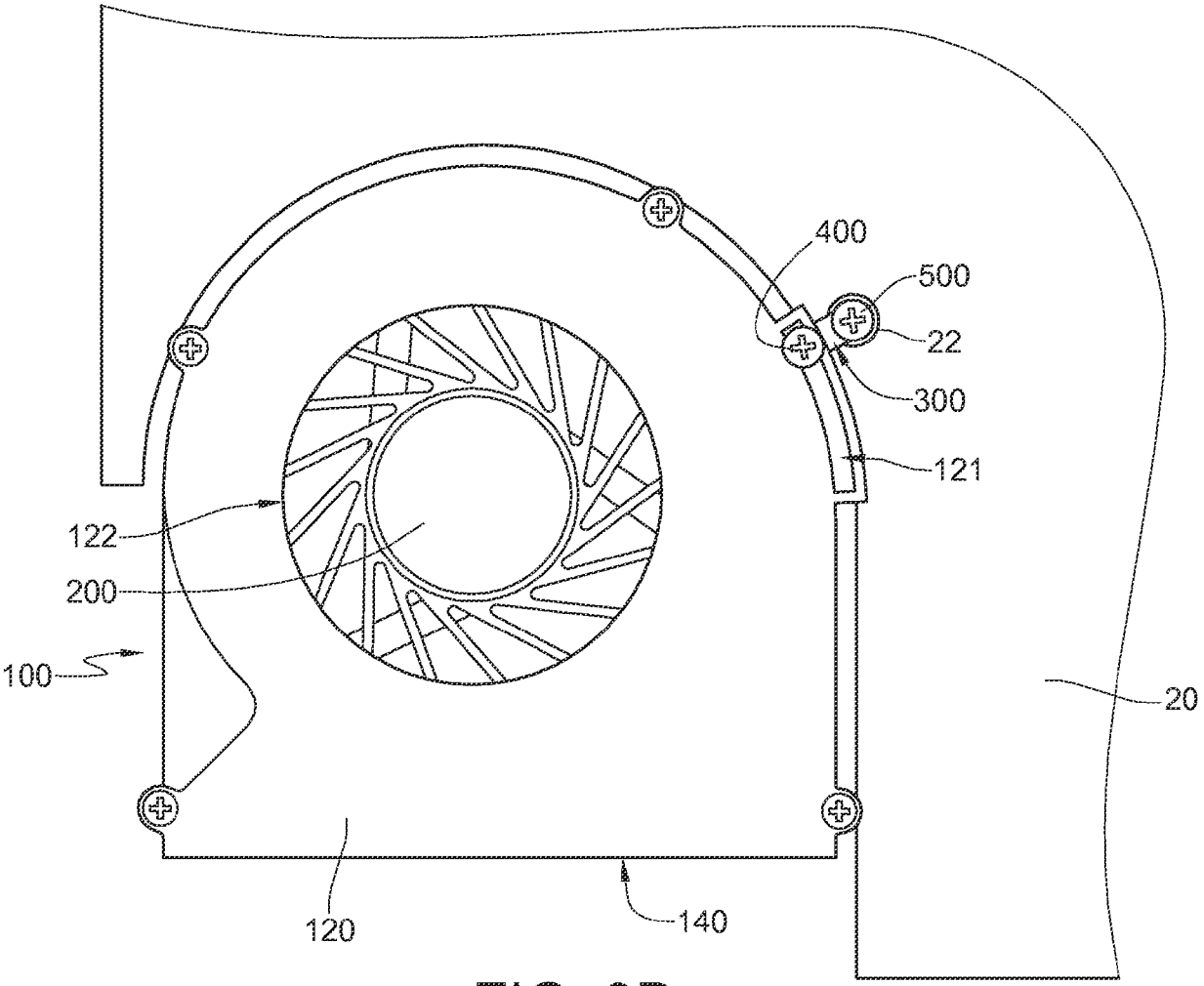

Please refer to FIG. 3A and FIG. 3B. FIG. 3A and FIG. 3B are plan views of different locking holes in FIG. 1. In this embodiment, since the sliding member 300 having the locking hole 321 is movably disposed in the adjustment slot 113, an assembler may adjust the position of the locking hole 321 of the sliding member 300 along the predetermined track of the adjustment slot 113. As shown in FIG. 3A, when assembling the fan structure 10 and the plate body 20, an assembler may adjust the position of the locking hole 321 to make the locking hole 321 match the locking portion 22 of the plate body 20. Thereby, the locking member 500 is configured for being disposed through the joining portion 320 and the locking portion 22 and is locked thereto. Alternatively, as shown in FIG. 3B, when the fan structure 10 is desired to be assembled to another plate body 20' having different locking portion 22', a assembler may adjust the position of the locking hole 321 of the sliding member 300 along the track of the adjustment slot 113, so as to make the position of the locking hoe 321 match the position of the locking portion 22' of the plate body 20'.

In this embodiment, the locating method is a stepless adjustment. Hence, an assembler may change the relative positions between the sliding member 300 and the adjustment slot 113 if required, so as to adjust the position of the locking hole 321. Thereby, the fan structure 10 may match the plate body 20 having a different position of the locking portion 22.

Figure 4:
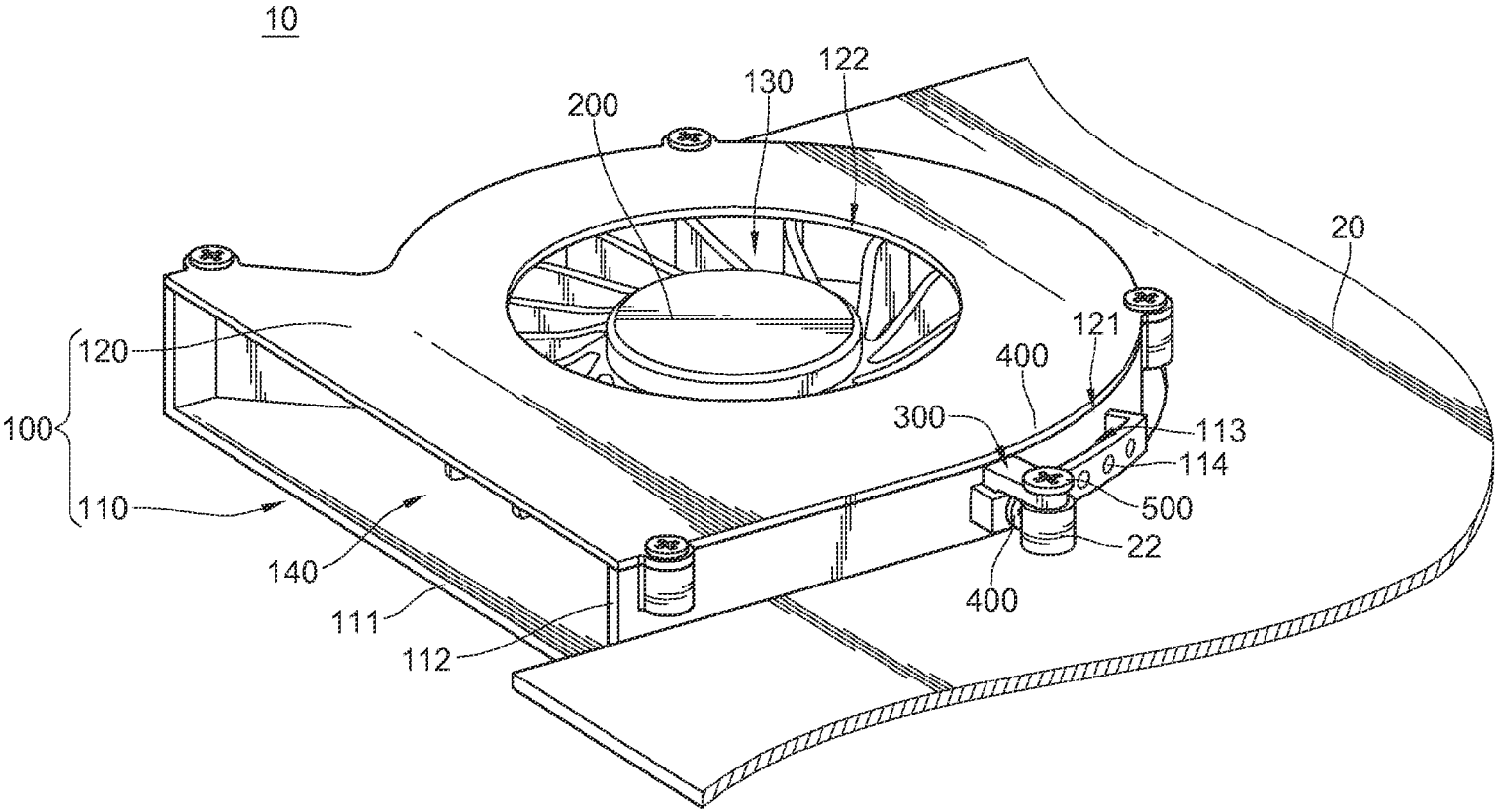
FIG. 4 is a fan structure according to another embodiment of the disclosure.
Figure 5:
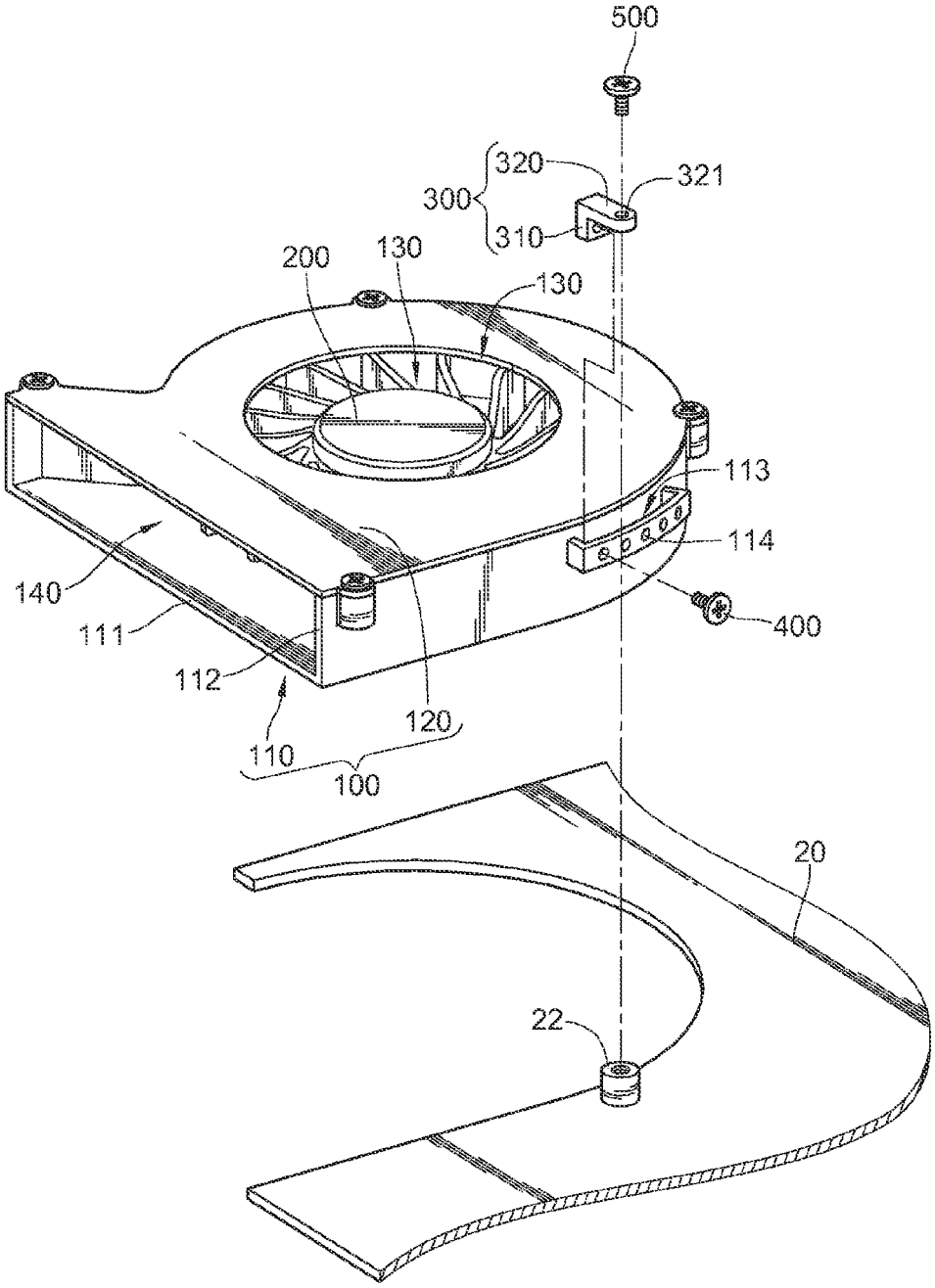
FIG. 5 is an exploded view of FIG. 4.

In other embodiment, however, the locating method is not limit to the stepless adjustment. Pleas refer to FIG. 4 and FIG. 5. FIG. 4 is a fan structure according to another embodiment of the disclosure. FIG. 5 is an exploded view of FIG. 4. In this embodiment, the locating method of the fan structure 10 is a multi-steps adjustment. The structure of this embodiment is similar to that of the embodiment in FIG. 1 so only the differences between them are illustrated.

In this embodiment, the fan structure 10 comprises a main body 100, a fan blade 200, a sliding member 300 and a locating member 400. The main body 100 has an accommodating space 130, an adjustment slot 113 and a plurality of locating holes 114. The adjustment slot 113 forms a predetermined track. The locating holes are configured for interconnecting the adjustment slot 113. Specifically, the locating holes are located on the main body 100, and are arranged at regular intervals along the direction of the track of the adjustment slot 113.

The fan blade 200 is pivotally disposed on the main body 100, and is located inside the accommodating space 130. The sliding member 300 has a base 310 and a joining portion 320 connected to each other. The base is movably accommodated in the adjustment slot 113. The joining portion 320 has a locking hole 321. The locking hoe 321 is disposed through the locking hole 321 via a locking member 500 and is joined to the locking portion 22. Thereby, the fan structure 10 is made to be joined to the plate body 20 via the sliding member 300.

The locating member 400 is configured for being disposed through one of the suitable locating holes 114 based on the position of the locking portion 22 and thereby locked to the sliding member 300. Specifically, the locating member 400 is, for example, a screw. The locating member 400 is disposed through the locating hole 114 and the sliding member 300 and locked thereto. Thereby, the relative positions between the sliding member 300 and the main body 100 are fixed, and the position of the locking hole 321 of the joining portion 320 is made to match the position of the locking portion 22 of the plate body 20. When the position of the locking hole 321 of the sliding member needs to be changed, users may disassemble the locating member 400 before adjusting the relative positions between the sliding member 300 and the main body 100. Subsequently, the purpose of the adjustment of the position of the locking hole 321 is reached via locking the locating member 400 to the another suitable locating hole 114 to make the sliding member 300 and the main body 100 fix to each other.

In the fan structure and the casing structure of the embodiments of the disclosure mentioned above, the sliding member is movably disposed in the adjustment slot, and the adjustment of the position of the locking hole is finished via a stepless or multi-steps adjustment method. This, the fan structure can be assembled to different plate bodies with different specifications.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A fan structure configured for connecting with a plate body, comprising:

a main body having an accommodating space and an adjustment slot, the main body comprising a carrier and a cover, the carrier comprising a bottom plate and a lateral plate erecting and adjacent to the bottom plate, the cover fixed to the lateral plate, the carrier and the cover forming the accommodating space, and the accommodating slot located on the exterior wall of the lateral plate, wherein the exterior wall is a side, next to the plate body, of the lateral plate;

a fan blade pivotally disposed on the bottom plate of the main body and located inside the accommodating space;

a sliding member having a base and a joining portion, the base being accommodated in the adjustment slot, the sliding member is joined to the plate body through the joining portion; and a locating member configured for joining the sliding member and the main body together, so as to fix the position of the sliding member relative to that of the main body.

2. The fan structure according to claim 1, wherein the cover has a locating slot, the locating slot corresponds to the adjustment slot, and the locating member is disposed through the locating slot and is locked on the sliding member.

3. The fan structure according to claim 1, wherein the lateral plate has a plurality of locating holes, the locating holes are configured for interconnecting the adjustment slot, and the locating member is disposed through one of the locating holes and is locked on the sliding member.

4. The fan structure according to claim 1, further comprising a locking member, wherein the joining portion has a locking hole, and the locking member is disposed through the locking hole and is configured for being locked to the plate body.

5. The fan structure according to claim 1, wherein the main body has an air intake vent and an air outlet and both the air take vent and the air outlet interconnect the accommodating space.

* * * * *